United States Patent [19]

Muschong et al.

[11] Patent Number: 4,722,362

[45] Date of Patent: Feb. 2, 1988

[54] PILOT OPERATED 3/2 POPPET VALVE

[75] Inventors: Günther Muschong, Rechtenbach; Manfred Härtwig, Ostfildern, both of Fed. Rep. of Germany

[73] Assignee: Mannesmann Rexroth GmbH, Lohr, Fed. Rep. of Germany

[21] Appl. No.: 912,127

[22] Filed: Sep. 26, 1986

[30] Foreign Application Priority Data

Sep. 26, 1985 [DE] Fed. Rep. of Germany ..... 3534387

[51] Int. Cl.[4] ..... F15B 13/043

[52] U.S. Cl. ..... 137/596.16; 137/596.14; 137/596.18; 137/625.27

[58] Field of Search ..... 137/596.14, 596.16, 137/596.18, 625.27, 625.6, 625.64

[56] References Cited

U.S. PATENT DOCUMENTS 2,617,444 11/1952 Gardner ..... 137/625.64
2,913,005 11/1959 Grant et al. ..... 137/625.6
3,608,587 9/1971 Zbell ..... 137/625.27 X
3,969,985 7/1976 Grieger ..... 137/625.64 X
4,026,193 5/1977 Olmsted ..... 137/596.14 X
4,616,674 10/1986 Bardoll ..... 137/596.18

FOREIGN PATENT DOCUMENTS 469024 7/1975 U.S.S.R. ..... 137/596.18

*Primary Examiner*—Gerald A. Michalsky
*Attorney, Agent, or Firm*—Cushman, Darby & Cushman

[57] ABSTRACT

A 3/2 directional poppet valve is provided having a pilot poppet valve and a main valve. Said main valve comprises a housing having a longitudinal bore within which two 2/2 cartridge or logic valves are arranged in an axially opposite manner. A spool is provided in each of said logic valves. The diameters of said spools being different and the front ends of said spools facing towards each other can be mechanically coupled such that the movement of the one or the other spool into the closing position causes a movement of the other spool out of its closing position.

3 Claims, 10 Drawing Figures

„C"

„U"

101
38
32
x
P
A
T
2
y
38

38
70
72
51
71
2
52
50
32
53
T
57
(y)
54
A
(x)
56
P
55
49

PILOT OPERATED 3/2 POPPET VALVE

DESCRIPTION

The invention relates to a pilot-controlled 3/2 directional poppet valve. The invention relates in particular to a 3/2 directional poppet valve having a pilot poppet valve.

The invention relates in particular to a pilot-controlled 3/2 directional poppet valve for a pressure medium like oil, but in particular also for a pressure medium, like water, or water emulsion.

BACKGROUND ART

German utility model No. 73 04 892 discloses a 4/2 directional control valve. Said valve uses a valve body which can be moved or actuated by an actuating spool because the closing spool is not guided directly within the sleeve which forms the seat. An offset situation can occur between the two conical seat-closing surfaces. Moreover, the minimum play required between the seat inner diameter and the dampening rod is larger than in a situation where the spool is directly guided within the seat portion. Therefore, the positive overlap is less effective in the annular gap thus formed and the amount of pressure medium passing through during the switching operation is larger, a situation which is particularly disadvantageous if the pressure medium is water.

A pilot-controlled poppet valve having two seats within the pump port chamber of the valve housing is already known. A spool, also having two seats, is reciprocally mounted between said two housing seats. Said movement occurs against the force of the pressure medium acting on the spool. For said purpose the spool is provided at its two opposite ends with differently sized pressure areas such that depending on the position of the pilot-controlled valve the spool is moved into the one or the other direction. This valve is of a complicated design. Specifically, the spool tends to tilt and does not operate precisely, a situation which will be particularly disadvantageous for water as the pressure medium.

It is also known to realize a pilot-controlled 3/2 poppet valve by means of so-called logic valves. This design will be discussed in some detail below. A disadvantage of this known design is the fact that the pilot valve has to be designed as a 4/2 directional valve, a fact which causes a doubling of cost because it has to be provided as a poppet valve.

It is an object of the invention to overcome the disadvantages of the prior art.

It is another object of the invention to provide a pilot-controlled 3/2 directional valve which can be manufactured at low cost. A still further object of the invention is to provide a pilot-controlled 3/2 directional poppet valve which can easily be assembled and operates with high precision. It is another object of the invention to provide the 3/2 directional valve such that standardized components can be used.

DISCLOSURE OF THE INVENTION

In accordance with a first aspect of the present invention a 3/2 directional poppet control valve having a pilot poppet valve is provided for controlling a main valve. The main valve comprises a housing having a longitudinal bore within which two 2/2 logic or cartridge valves are located in an axially opposite relationship. Each of said cartridge valves comprises a spool.

Said spools have different diameters and their end faces can mechanically be coupled such that for the movement of the one or the other spool into the appropriate sealing position the respective other spool is moved out of its sealing position.

In a second aspect of the present invention a 3/2 control poppet valve is provided which is particularly useful as a pilot valve. The directional poppet valve comprises two logic valves which are located coaxially on the longitudinal axis of a longitudinal bore of a housing. The logic valves are provided at their front ends with connecting means such that the spool of the logic valve having the greater diameter n +1 opens the smaller spool of the logic valve having the smaller diameter n which is subjected to the same control pressure as is the spool with the larger diameter.

Preferred embodiments are disclosed in the dependent claims.

BRIEF DESCRIPTION OF THE DRAWINGS

For a better understanding of the present invention reference may be made to the accompanying drawings in which

At the outset, a pilot controlled 3/2 directional poppet valve 10 of the prior art will be discussed in connection with FIGS. 1 and 4. The directional poppet valve 10 comprises as a pilot stage a 4/2 directional poppet valve 11 directly actuated by a solenoid, and two 2/2 directional cartridge valves (logic valves) 13 and 17. FIG. 4 shows in a sectional view some details of the schematic representation of FIG. 1. FIG. 1 shows a valve housing 20 having a longitudinal bore within which the two logic valves 13 and 14 are located. Each of said logic valves 13, 17 comprises a spool 18 and 19, respectively. Spool 18 is reciprocally mounted within a sleeve 21 and spool 19 is reciprocally mounted within a sleeve 22. Spool 18 is adapted to cooperate with a seat 26 and spool 19 is adapted to cooperate with a seat 27. Seat 26 is provided in sleeve 21 and seat 27 is provided in sleeve 22. The tank port is referred to by reference numeral 23, the load port is referred to by 24 and the pump port is referred to by reference numeral 25.

FIG. 2 discloses the symbol of a pilot controlled 3/2 directional poppet valve 10 in the so-called C-mode of operation. The so-called U-mode of operation shown by the symbol of FIG. 3 is also possible but not shown in FIG. 2.

In FIG. 1 the 3/2 directional poppet valve 10 is in its first switching position, called zero position, i.e. pump port 25 (P) is connected with load port 24 (A) and tank port 23 (T) is blocked. The switching operation for this known design is carried out by selectively supplying pressure to, or relieving pressure from the two logic valves 13 and 17, respectively.

Figure 5:
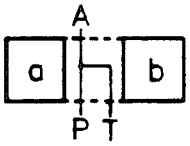
FIG. 5 shows symbolically the negative overlap occuring in a valve of FIG. 1.

This known pilot controlled 3/2 directional poppet valve 10 provides for a negative overlap due to its design, as is shown in FIG. 5. As a consequence, there occurs for a short period of time a flow from P to A to T inasmuch as both logic valves 13 and 17 will come into operation simultaneously. When carrying out the switching operation the logic valve which has closed so far will be opened and the logic valve which was open so far will be closed. This negative overlap is undesirable and can be influenced and reduced to a minimum by providing dampening ends 28, 29 and by adjusting throttle or nozzle means.

Figure 1:
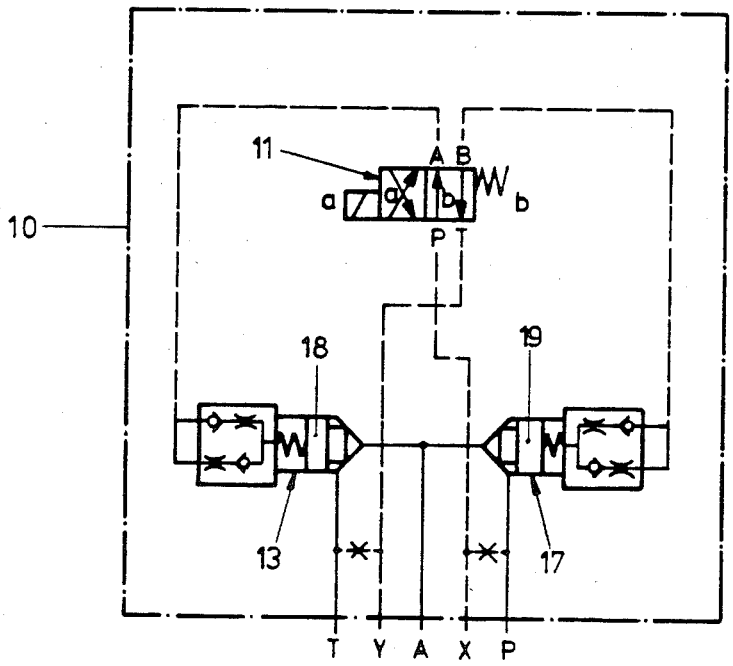
FIG. 1 is a schematic representation of a pilot-controlled 3/2 directional valve of the prior art.
Figure 2:
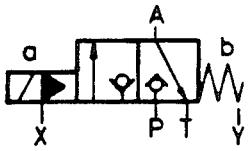
FIG. 2 is the symbol of a 3/2 directional valve providing for the so-called C-function, a function which can be realized with the circuit arrangement of FIG. 1.
Figure 3:
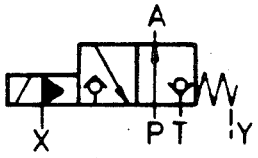
FIG. 3 shows the symbol of a 3/2 directional valve providing for a a U-function, a function which can be realized with the circuit arrangement of FIG. 1.
Figure 4:
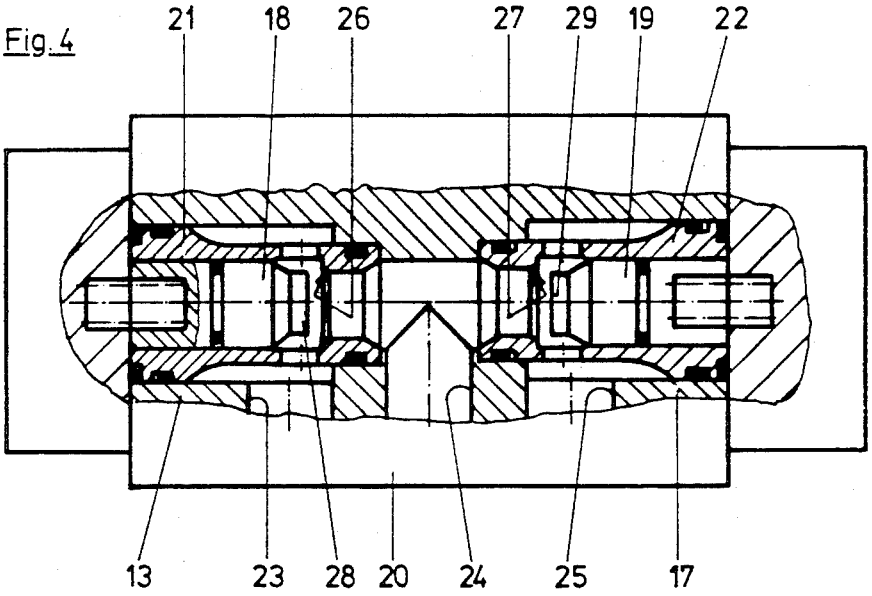
FIG. 4 is a partial sectional view of the two logic valves of FIG. 1.

Nevertheless there remain problems with regard to the negative overlap. Another disadvantage of the valve 10 of FIG. 1 resides in the fact that the pilot valve is a 4/2 directional poppet valve 11. To use a 4/2 directional poppet valve as a pilot valve has the consequence that almost twice as much money has to be invested compared with the use of a 3/2 pilot directional poppet valve.

Figure 7:
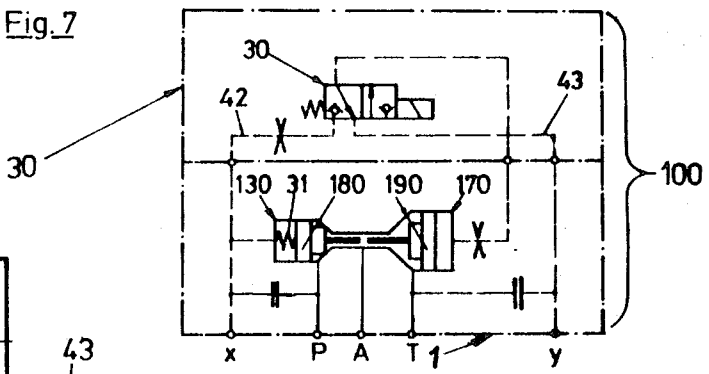
FIG. 7 is a detailed representation of the valve of FIG. 6 providing for the C-function.
Figure 6:
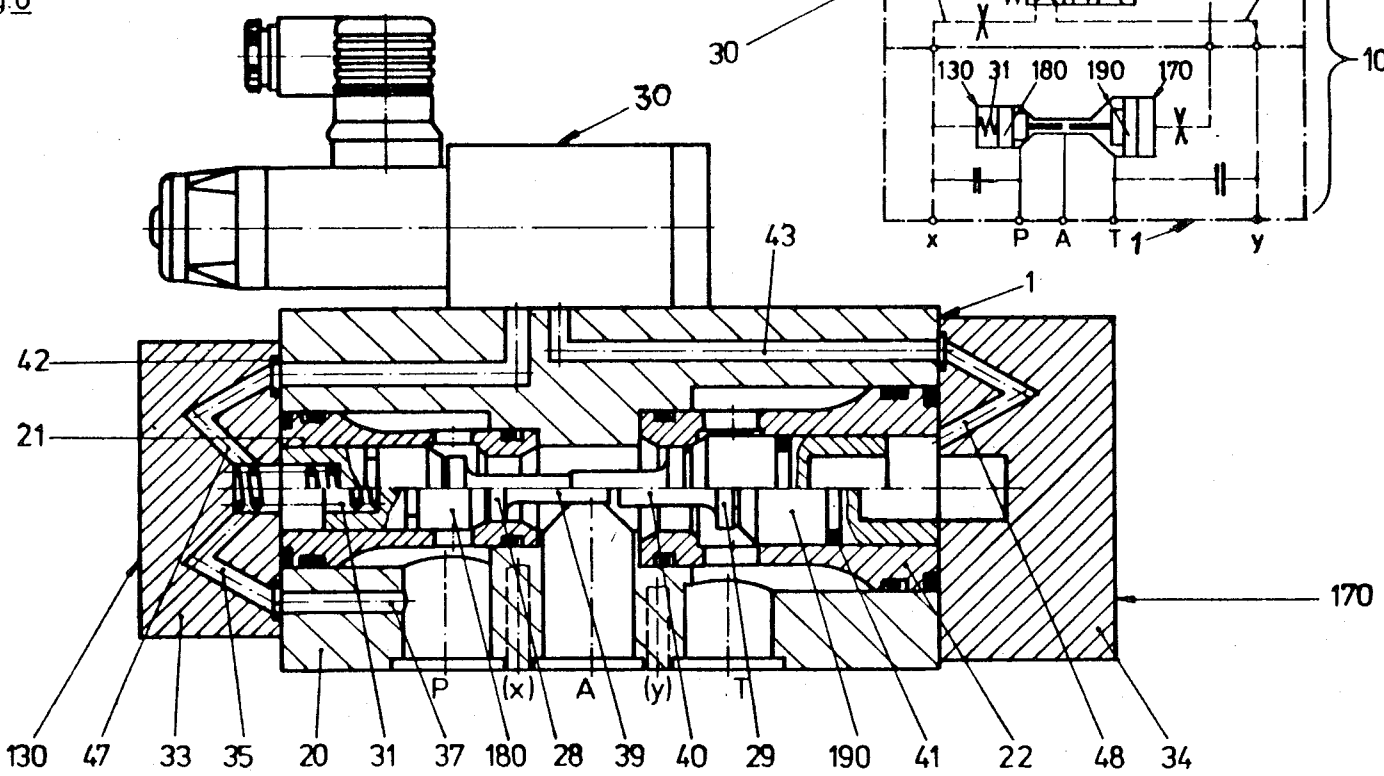
FIG. 6 is a partial longitudinal sectional view of a first embodiment of a pilot-controlled 3/2 directional poppet valve.
Figures 8, 9:
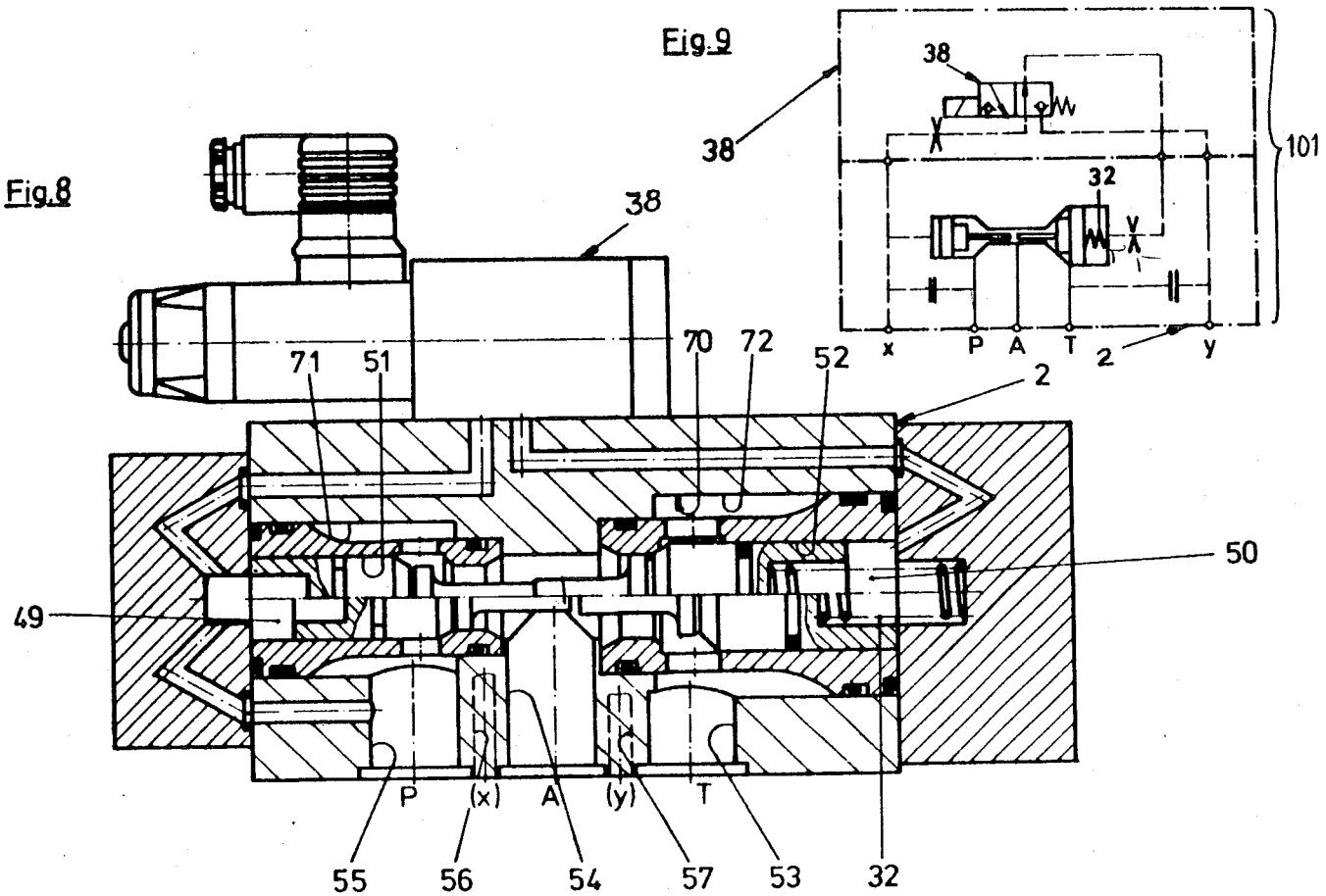
FIG. 8 is a partial longitudinal sectional view of a second embodiment of a pilot-controlled 3/2 directional poppet valve.
FIG. 9 is a detailed symbol of the valve of FIG. 8 providing the U-function.

The following description will firstly refer to two closely related embodiments shown in FIGS. 6 and 7 and in FIGS. 8 and 9, respectively. Thereupon a further, third embodiment of the invention will be discussed in connection with FIG. 10.

The two related embodiments of FIGS. 6 and 7 as well as of FIGS. 8 and 9 will now be discussed. The pilot controlled 3/2 directional poppet valve 100 of FIGS. 6 and 7 differs from the pilot controlled 3/2 directional poppet valve 101 insofar as the first mentioned valve 100 provides for the C valve operation, while the valve 101 provides for the U valve function, both valves 100 and 101 operate with positive overlap.

The essential difference between valve 100 and valve 101 is the fact that valve 100 uses in the control stage a 3/2 pilot directional poppet valve with C-function, while the first stage of valve 101 uses a 3/2 pilot directional poppet valve with U-function.

Moreover, the main valve 1 of the pilot controlled 3/2 directional poppet valve 100 uses a closing spring 31 so as to assure the C-function, while the U-function of the main valve 2 of the pilot controlled 3/2 directional poppet valve 101 is assured by a closing spring 32.

Inasmuch as the two main valves 1 and 2 do not differ from each other with the exception for the differently arranged springs 31 and 32, respectively, the two main valves 1 and 2 will be described below together and by referring to FIGS. 6 and 8 simultaneously. For reasons of clarity some of the reference numerals are shown only in FIG. 6 and some are only shown in FIG. 8.

The pilot controlled 3/2 directional poppet valve 100 comprises in its first pilot stage a 3/2 pilot poppet valve 30 providing for the C mode of operation and in the main or second stage a main valve 1 is provided. Main valve 1 comprises a valve housing 20. In a longitudinal bore 70 of the valve housing 20 two 2-way-cartridge valves (also referred to as logic valves) 130 and 170 are arranged and are located oppositely to each other. Valve 130 is provided with a cover 33 within which a passage 35 is provided. Valve 130 further comprises a sleeve 21 having a first rated width or diameter n. The sleeve 21 is located in a manner known per se within the corresponding bore section 71 of the longitudinal bore 70. Within said sleeve 21 a spool 180 is reciprocally mounted. The front face of the spool 180 is provided with a dampening end 28. The dampening end 28 is adapted for cooperation with a corresponding bore 85 of sleeve 21 so as to provide for the desired positive overlap.

Moreover, from the front face of the spool 180 a pin 39 extends in the direction of the longitudinal bore 70. Said pin 39 is adapted for cooperation with a pin 40 yet to be described, a pin 40 which is provided at the oppositely arranged spool 190 of logic valve 170. The logic valve 170 is of symmetric design with respect to logic valve 130 and similarly comprises a cover 34 as well as a sleeve 22 within which said spool 190 is reciprocally mounted. Further, a dampening end 29 is provided and the already mentioned pin 40 projects from the front end of spool 190. The dampening end 29 cooperates with a bore 59 so as to achieve positive overlap.

In accordance with the invention the spool 190 as well as the appropriate sleeve 22 have a larger diameter than the spool 180 and the appropriate sleeve 21. Sleeve 21 is located in a bore section 72 of the longitudinal bore 70.

Preferably, the spool 190 has a rated size of $n+1$. As a consequence, standard components may be used when assembling the main valve 1. Only the already mentioned pins 39 and 40 have to be provided at the appropriate spools 180 and 190, respectively. In the embodiment of FIGS. 6 and 7 the closing spring 31 is located within spool 180 and urges said spool 180 towards the first or zero switching position of the valve 100 and against the appropriate seat. FIG. 7 shows the first or zero switching position. The second switching position is shown in the upper half of the sectional view of FIG. 6.

As already mentioned main valve 2 differs from main valve 1 only insofar as main valve 2 comprises a closing spring 31 which biases spool 190 against its appropriate seat in the first or zero switching position. The upper section of the sectional representation of FIG. 8 shows this condition. The second switching position is shown in the lower half of the sectional view of FIG. 8.

In a manner known per se the two valves are connected to a pump P (not shown) by means of a pump port 55, to a load A (not shown) by means of a load port 50 for and to a tank T (not shown) by means of a tank port 53. Further, pilot oil ports x and y are provided. According to the more detailed representations of FIGS. 7 and 9 the pilot oil ports may be connected in a manner known per se directly with the pump P or the tank T even so this alternative arrangement is not shown in FIGS. 7 and 9. In fact, FIGS. 6 and 8 show a connection between the pump port 55 and pilot control valve 30 and 38, respectively, via passages 37, 35, 47 and 42 in valve housing and cover 130. Further, a control chamber 49 (FIG. 8) for actuating one of said spools is connected with passage 35 (FIG. 6). It would also be possible to use the pilot port bore 56. On the other hand the 3/2 pilot poppet valves 30 and 38, respectively, which form the pilot control valves, are connected with the Y-pilot port bore 57, and a passage 43 in housing 20 and a passage 48 in cover 34 provide for the connection to the control space or chamber 50.

The operation of the two pilot controlled 3/2 directional poppet spool valves will be described below.

The pilot controlled 3/2 directional poppet valves 100 and 101, respectively, selectively connect the load port 54 of a load A with the pump port 55 of a pump, or with the tank port 53 of the tank, whereby the closing effect with respect to the closed port is provided in a leakage-free manner. Each of the main valves 1 and 2, respectively, are pilot controlled by means of the appropriate pilot valve in the form of the 3/2-pilot poppet valves 30 and 38, respectively. The switching symbol of the entire valve 100 and 101, respectively, is determined by the switching symbol of the pilot valve 30 and 38, respectively.

Preferrably, the pilot control valve is a 3/2 directional poppet valve as described. In special cases the pilot valve can be a 3/2 or a 4/3 directional spool valve.

Basically, the pilot control ports x and y, respectively, can be connected externally, i.e. they are separated from the operating or pressure medium. Alternatively, the pilot control ports can be connected internally, i.e. "x" is connected with P and/ or "y" is connected with "T". The zero or initial switching position (the first switching position) of the main valve 30 is determined in the pressureless condition of the valve by the suitable arrangement of closing springs 31 and 32, respectively. It is simply possible to delete the spring of the spool 180 or 190, i.e. the spool which should be in the zero position for the valve being in its "open" condition. In accordance with the invention two coaxially and oppositely arranged logic valves 13 and 17 are provided within the housing in the form of so-called cartridge sets. One of said a cartridges 13 has a nominal width of n and is assigned to pump port 55 (P). The other cartridge set 17 has the nominal width of n+1 is assigned to tank port 53. As a consequence a low cost design is achieved. The functional principle of the invention makes use of the larger control surface of the closing spool 190 which leads to an additional closing energy which is used for opening the smaller spool 180 which is subjected to the same control pressure, as is the larger diameter spool. Said opening being carried out by a coupling or connecting means provided for the spools 180 and 190. Said coupling means are shown in the form of pins 39 and 40.

As mentioned above, so far the logic valves contained in a housing were hydraulically connected, a situation which would require in the present case a 4/2 directional pilot valve. This would mean for poppet valves twice the expenses.

Due to the pins 39 and 40 provided by the invention each of the spools 180 and 190 is used twice, firstly as a passage closing element and, secondly, at the same time as an active force transmitting element, a force transmitting element which transmits the force created by the control pressure on the spool surface onto the appropriate partner spool. Due to the different nominal sizes of the two spools 180, 190 a well defined switching position is always achieved and an excess amount of force remains, a force which is required for poppet valves as holding force so as to achieve the required tightness or sealing effect.

The mode of operation of the valve 100 of FIGS. 6 and 7 will now be discussed. The control chamber 49 of the smaller logic valve 130 is continuously connected with the source of pilot pressure medium, either externally at "X" or interally (as is shown). The control chamber 50 of the larger logic valve 170 is vented to tank T via pilot valve 39. Inasmuch as spool 190 is not subjected to the pressure of a built-in spring, the path from P to A is closed free of leakage, while the path from A to T is opened. The switching from the zero position into the first switching position occurs by actuating the pilot valve 30 as a consequence of which the control surface (the pressurized surface) of the spool 190 is subjected to pressure. Inasmuch as said control surface is larger than the control surface of the spool 180 a resulting force is created which will act in the direction of opening of the smaller spool 180 by means of the connection or coupling 39, 40 which is formed in the embodiment shown by the two pins 39 and 40. The switching process shows a positive overlap, i.e. in the intermediate position user port 54 (A) is blocked from the pump port 55 and is also blocked from tank port 57 (T). This blocking is affected by a radial annular gap formed by the play between the dampening ends 28 and 29, respectively, and the inner seat diameter (bore) 58 and 59, respectively. The fitting is for this embodiment much larger than for comparable spool valves, inasmuch as a contact between the dampening ends 28 and 29, respectively, and the sleeves 21 and 22, respectively, has to be avoided under all circumstances. Moreover, the tilting of the spools 180 and 190, respectively, in the sleeves 21 and 22, respectively, has to be considered and as a consequence the play is again increased. Therefore, the positive overlap will allow a substantially larger amount of pressure medium to flow during the switching operation, as is true for a comparable spool valve. So as to get rid of this remaining disadvantage, the embodiment of FIG. 10 discloses an embodiment where dampening ends for obtaining a quasi positive overlap are not used.

Figure 10:
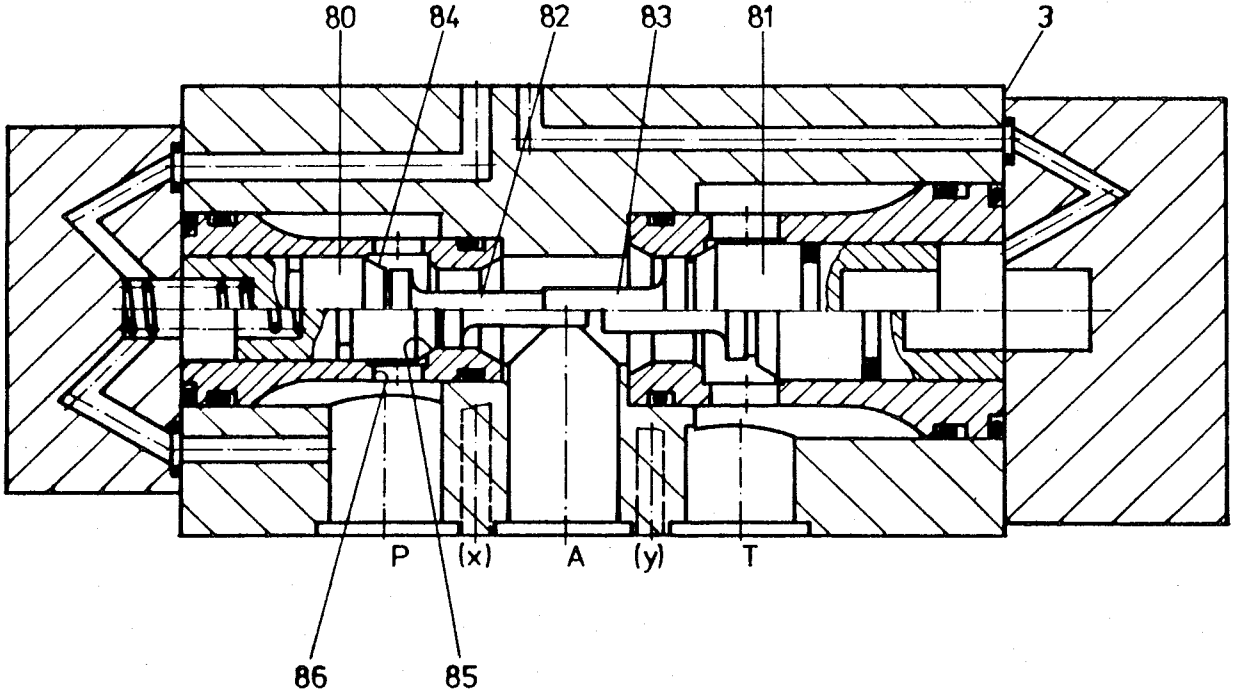
FIG. 10 is a third embodiment of the invention shown as a longitudinal sectional view with the pilot valve being deleted for reasons of simplicity.

The third embodiment presented in FIG. 10 does actually show only the main valve 3. The pilot control valve 30 of FIGS. 6 and 7 or 38 of FIGS. 8 and 9 can also be used in connection with the embodiment of FIG. 10. In contrast to the two embodiments described before, spools 80 and 81, respectively, do not carry a dampening end. The pins 82 and 83, respectively, which are also present in the third embodiment extend directly from the face ends of the spools 80 and 81, respectively. The face ends form the spool seating surfaces 84. The spool seating surface 84 simply cooperate with a sleeve seating surface 85. For reasons of clarity said seating surfaces are referred to by reference numerals shown for only one of said spools in FIG. 10.

The length of the pins 82 and 83, respectively, is determined in the same manner as the length of pins 39 and 40, respectively, the determination being made according to the desired function of the main valve.

The embodiment of FIG. 10 allows for a simpler shape of the spools 80 and 81. Because the fitting between the dampening ends and the appropriate bores is no longer necessary, the manufacturing cost are reduced.

Moreover, a better guiding of the spool along its entire length and in every switching position is achieved.

Moreover, a significantly improved positive overlap is achieved due to the reduced play similar to a spool and due to the fact that the second fitting is not required. The second fitting had to be selected relatively large, so as to avoid a contact between spool and sleeve in the dampening range; therefore, in the embodiment of FIG. 8 the radial play was larger and consequently the hydraulic resistance required for a positive overlap at this location was significantly smaller than for the new design.

Moreover, a softer switching operation of the logic valves is achieved due to the progressively increased cross-section of the radial bores 86 in the sleeve which are covered by the spool.

Summarizing it can be said that the pilot controlled 3/2 directional poppet valve uses preferably a 3/2 pilot poppet valve 30 and 38, respectively. The main valve 1, 2, 3 is defined by two logic valves 130 and 170, respectively. Each of the logic valves has spools with different diameters. The spools are movable between a closing or sealing position and an opening position. The two spools are basically independently movable from each other. The spools can however be mechanically coupled or brought into engagement such that always only the one or the other spool is in its sealing position. Preferrably, the one or the other spool can be biased into its sealing position by spring means. So as to provide for said coupling effect between said two spools preferrably pin means are provided. Each one pin is provided at each one spool 180 and 190, respectively. If necessary, only one pin may be provided at one spool. The sum of the length of the two pins 39 and 40 is selected such that a small distance remains between the pins 39 and 40 when the one or the other spool is in its closing position. The appropriate other spool will then be in its full opening position.

In accordance with the invention one of the logic valves 180 and 190, respectively, is designed such that the pressure medium is supplied from the pump P in a radial direction to the valve (for instance 180) while the other valve (for instance 190) is radially connected with the tank T. The front ends of both logic valves 180, 190 are commonly connected with the user A, i.e. the user port 54. The pins need not be supported in the valve housing 20.

So as to provide for a self-closing operation of the 3/2 directional poppet valve, a direct connection 37, 35 is provided between the pump port 54 and the control chamber 49 as well as between the pilot medium supply of the pilot poppet valve 30, 38.

We claim:

1. A 3/2-directional control valve apparatus including pilot valve and a main valve controlled by said pilot valve, said main valve comprising:

a housing having a longitudinal bore extending therethrough and defining a first end and a second end, a first sleeve having a first inner diameter and being inserted into said bore from said first end, said first sleeve defining a first seat, a second sleeve having a second inner diameter and being inserted into said bore from said second end, said second sleeve defining a second seat, said second diameter being larger than said first diameter, a first spool having a diameter corresponding to said first diameter and adapted to cooperate with said first seat to define a closed position and an open position, said first spool having a first front face, said first sleeve and said first spool defining a first logic (2/2) valve, a second spool having a diameter corresponding to said second diameter and being adapted to cooperate with said second seat to define a closed position and an open position, said second spool having a second front face facing towards said first front face, said second sleeve and said second spool defining a second logic (2/2) valve, a first pin projecting from said first front face; and a second pin projecting from said second front face, said first and second spools being adapted to be coupled by means of said first and second pins such that movement of one of said first and second spools into the closed position thereof causes the movement of said other spool out of the closed position thereof.

2. A 3/2-directional control valve comprising:

a housing having a longitudinal bore extending therethrough and defining a first end and a second end, a first sleeve having a first inner diameter and being inserted into said bore from said first end, said first sleeve defining a first seat;

a second sleeve having a second inner diameter and being inserted into said bore from said second end, said second sleeve and defining a second seat, said second diameter being larger than said first diameter, a first spool having a diameter corresponding to said first diameter and adapted to cooperate with said first seat to define a closed position and an open position, said first spool having a first front face, said first sleeve and said first spool defining a first logic (2/2) valve, a second spool having a diameter corresponding to said secnd diameter and adapted to cooperate with said second seat to define a closed position and an open position, said second spool having a second front face facing towards said first front face, said second sleeve and said second spool defining a second logic (2/2) valve;

a first pin projecting from said first front face, and a second pin projecting from said second front face, said first and second spools being adapted to be coupled by means of said first and second pins such that a movement of one of said first and second spools into the closed position thereof causes the movement of said other spool out of the closed position thereof.

3. The invention of claim 2 wherein said valve is operated by a pilot valve.

* * * * *